US012624463B2

(12) United States Patent
Grader et al.

(10) Patent No.: US 12,624,463 B2
(45) Date of Patent: May 12, 2026

(54) SYSTEMS AND METHODS FOR CONTINUOUS GENERATION OF GASES

(71) Applicants: H2PRO LTD, Caesarea (IL); TECHNION RESEARCH AND DEVELOPMENT FOUNDATION LTD., Haifa (IL)

(72) Inventors: Gideon Grader, Haifa (IL); Avner Rothschild, Haifa (IL); Hen Dotan, Richan (IL); Avigail Landman, Haifa (IL); Asaf Kay, Kiryat Ata (IL); Mordechay Moshkovich, Raanana (IL)

(73) Assignees: H2PRO LTD, Caesarea (IL); TECHNION RESEARCH AND DEVELOPMENT FOUNDATION LTD., Haifa (IL)

( * ) Notice: Subject to any disclaimer, the term of this patent is extended or adjusted under 35 U.S.C. 154(b) by 659 days.

(21) Appl. No.: 18/040,191

(22) PCT Filed: Aug. 4, 2021

(86) PCT No.: PCT/IL2021/050947
§ 371 (c)(1),
(2) Date: Feb. 1, 2023

(87) PCT Pub. No.: WO2022/029777
PCT Pub. Date: Feb. 10, 2022

(65) Prior Publication Data

US 2023/0313391 A1 Oct. 5, 2023

Related U.S. Application Data

(60) Provisional application No. 63/105,599, filed on Oct. 26, 2020, provisional application No. 63/060,818, filed on Aug. 4, 2020.

(51) Int. Cl.
*C25B 9/60* (2021.01)
*C25B 1/04* (2021.01)
(Continued)

(52) U.S. Cl.
CPC ..... *C25B 9/13* (2021.01); *C25B 1/04* (2013.01); *C25B 9/30* (2021.01); *C25B 9/40* (2021.01); *C25B 15/087* (2021.01)

(58) Field of Classification Search
CPC ..... C25B 9/13; C25B 9/30; C25B 15/087; C25B 9/40; C25B 1/04; C25B 15/08; C25B 9/60; C25B 9/75; C25B 9/77; C25B 11/04
See application file for complete search history.

(56) References Cited

U.S. PATENT DOCUMENTS

2004/0053132 A1 3/2004 Smedley et al.
2012/0298527 A1* 11/2012 James ..... C25B 9/40 205/754
(Continued)

FOREIGN PATENT DOCUMENTS

JP 2019-117792 A 7/2019

OTHER PUBLICATIONS

International Search Report issued for corresponding PCT/IL2021/050947, mailed Nov. 4, 2021, 3 pages.

*Primary Examiner* — Zulmariam Mendez
(74) *Attorney, Agent, or Firm* — Vorys, Sater, Seymour and Pease, LLP; Maryellen Feehery Hank

(57) ABSTRACT

Provided is a system for continuous generation of gases, the system including an electrochemical device and an active-material regeneration device.

8 Claims, 7 Drawing Sheets

(51) Int. Cl.

| | |
|---|---|
| ***C25B 9/13*** | (2021.01) |
| ***C25B 9/30*** | (2021.01) |
| ***C25B 9/40*** | (2021.01) |
| ***C25B 9/75*** | (2021.01) |
| ***C25B 9/77*** | (2021.01) |
| ***C25B 11/04*** | (2021.01) |
| ***C25B 15/08*** | (2006.01) |

(56) References Cited

U.S. PATENT DOCUMENTS

| | | | |
|---|---|---|---|
| 2014/0072836 | A1 | 3/2014 | Mills |
| 2017/0306510 | A1* | 10/2017 | Rothschild ..... C25B 1/55 |
| 2018/0269516 | A1 | 9/2018 | Wang et al. |

* cited by examiner

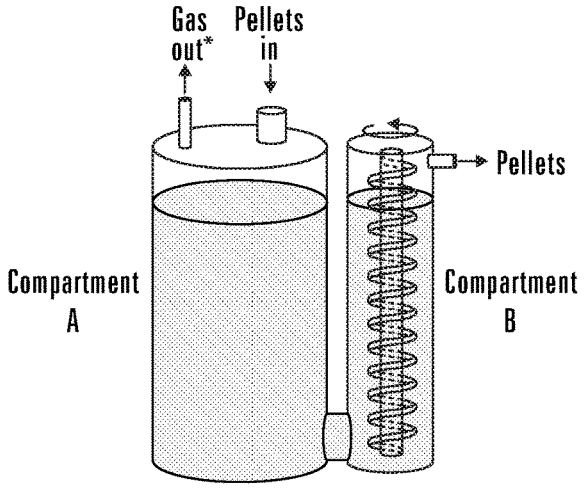
Basic Cell Design
FIG. 6A
FIG. 6B
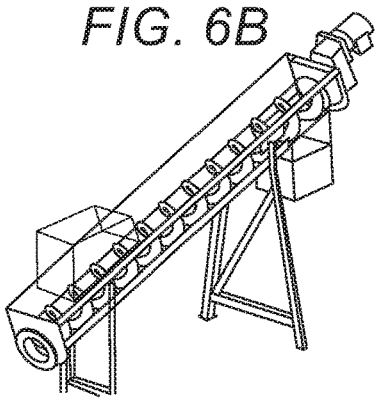
Screw Conveyor
FIG. 6C
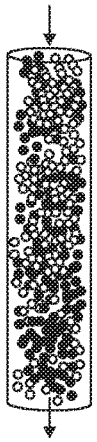
Packed-Bed
FIG. 6D
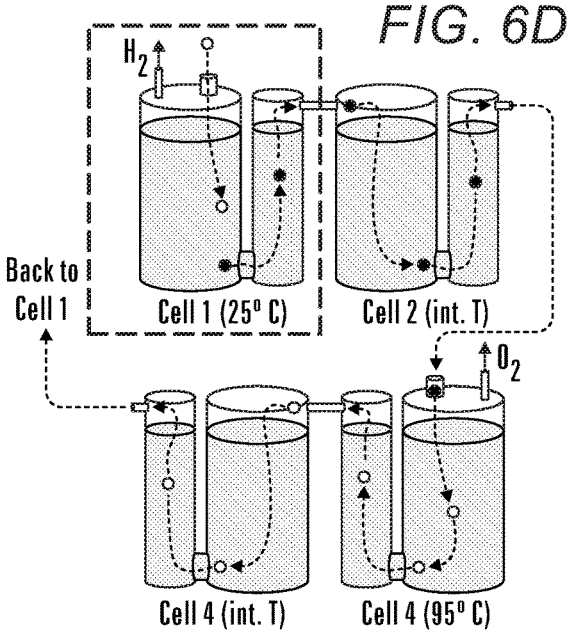
Four-Cell System
FIG. 6E
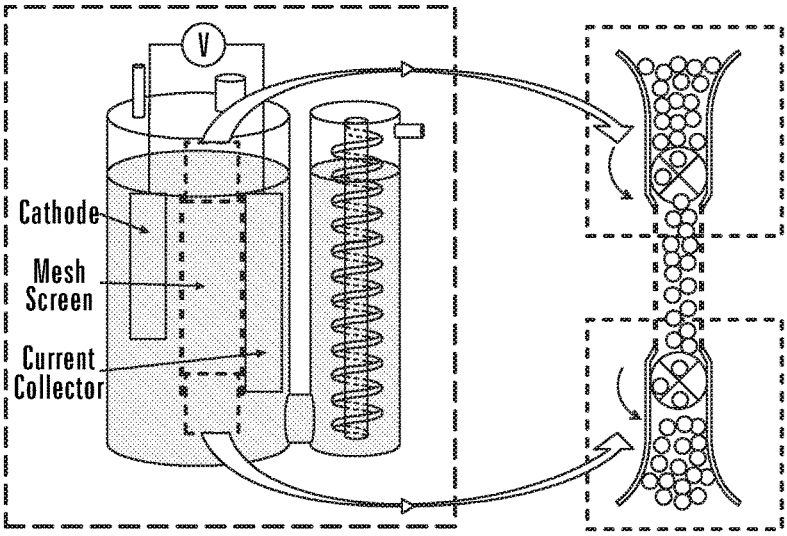
Hydrogen-Cell
FIG. 6F
Electrical Insulation Mechanism

SYSTEMS AND METHODS FOR CONTINUOUS GENERATION OF GASES

TECHNOLOGICAL FIELD

The present disclosure relates to electrochemical cells and methods for continuous generation of gases.

BACKGROUND

An electrochemical thermally activated chemical cell (E-TAC) and a system comprising a plurality of such electrochemical cells was developed [1,2], enabling alternate production of hydrogen gas and oxygen gas. In accordance with the technology, hydrogen gas is generated in an electrochemical step on a cathode electrode while charging the anode electrode, optionally by water reduction, whereas oxygen gas is generated in a spontaneous chemical step during regeneration of the anode. When shifting between one hydrogen production step to another, power is switched off and oxygen gas is produced during anode regeneration. In a system that comprises a plurality of electrochemical cells, when operation of one cell is stopped, operation of another cell may continue, thus enabling continuous production of hydrogen and oxygen gases. However, each cell works in a batch-swing mode, producing $H_2$ at one step and $O_2$ in a following step. Therefore, the system suffers from intrinsic fluctuations in the $H_2$ and $O_2$ production.

BACKGROUND ART

[1] International Patent Application publication WO 2016/079746.

[2] International Patent Application publication WO 2019/180717.

GENERAL DESCRIPTION

The present invention is based on the development of an electrochemical device configured to allow a continuous generation of hydrogen gas and/or oxygen gas by utilizing a redox-active material and specifically by controlling oxidation-reduction and movement of the redox-active material in its different oxidation states throughout the device.

The system of the invention enables regeneration of the electrodes, anode or cathode, without interrupting the continuous operation of the system. This is achieved by providing a system comprising two active sections or devices; one section or device being an electrochemical device which comprises an active electrode material (e.g., in a form of a flowing redox-active material) or an electrode assembly comprising at least one cathode and/or at least one anode, or a moving electrode assembly; and a second section or device, that is outside of or exterior to the first section, which acts as a regeneration device for regenerating the redox state of the active electrode material, as defined. The two sections are operably distinct but typically operable simultaneously, such that at any time point at least a portion or part of the active electrode material, either in a dispersion or suspension form or as part of an electrode, is transferred, transported or flown from the electrochemical device to the regeneration section, while the device operation continues.

The redox-active material or active material is a material that has the ability to undergo reversible oxidation-reduction, under different conditions, for example different temperatures and/or different electrical bias. The active material may be provided in the device as an electrode material, in which case the active material is a material from which the electrode, e.g., an anode, is made or a material which coats a region of the electrode surface, or as a suspension or a dispersion of the active material in an electrolyte aqueous medium. Alternatively, the active material may be provided in a form of flowing capsules or may be contained in a metallic or conducting polymer carrier such as polymeric particles. The redox active material may be in a reduced form (prior to oxidation) or in an oxidized form or may be in any intermediate state (e.g., partially oxidized, partially reduced). When in a reduced form or a partially reduced form, the redox-active material is capable of undergoing oxidation to revert back to (or generate) the oxidized or partially oxidized form and vice versa.

In a system of the invention, for enabling active material regeneration, each of the electrochemical devices comprises an electrode assembly wherein the active material is provided in two alternative forms:

(i) The electrode assembly comprises (a) at least one cathode electrode and at least one anode electrode or (b) a moving electrode; wherein the active material is provided as an electrode material, i.e., in the form of an active film on the electrode(s); and (ii) The active material is provided as active particles dispersed in the cell medium; wherein the electrode assembly comprises at least one cathode electrode or at least one anode electrode and at least one inert electrode; or is provided in a capsule form or encapsulated within a metallic or conducting polymer carrier (a plurality of such capsules or carriers).

When provided as active particles, the particles are of the electrode active material. Typically the active particles may be of a size ranging from nanometric to millimetric. In some embodiments, the particles are provided as material chunks of larger sizes and in a variety of shapes. In some embodiments, the active material is provided encapsulated within a metallic or conducting capsule (i.e., a form of fiber material), thereby permit flow of the electrolyte material through the capsules, yet protecting the active material from friction and abrasion.

In either configuration, the active material or encapsulated active material is caused to move or flow or be transported to the regeneration device for regeneration and subsequently moved or induced to flow back or return back into the electrochemical device. In embodiments where screw conveyors are utilized to move the active material or capsules from one device to the other, the flow rate will, at least partially, depend on the rotating rate at which is screw is operated: the faster it turns, the faster the active material or capsules are lifted out of one container and into the next container. In embodiments where pumps are used, the flow rate will depend on the pump operation parameters.

Thus, in most general terms, the invention provides a system for continuous generation of gases, the system comprising two separate vessels: an electrochemical device and an active-material regeneration device, wherein each vessel is equipped to provide functionality. The two vessels are external to each other, yet integrally associated within a system of the invention.

In a first aspect there is provided a system for continuous generation of gases, the system comprising an electrochemical device comprising one or more electrode assembly and a redox-active material, wherein the redox-active material is provided as an electrode material or as a dispersion thereof; and a redox-active material regeneration device that is external to the electrochemical device (not contained within the electrochemical device set up; namely active material regeneration does not occur within the electrochemical device).

The electrochemical device is a reactor or a plurality of reactors arranged and configured for generating a gas. In an electrochemical thermally activated chemical cell (E-TAC), hydrogen gas is generated in an electrochemical step on a cathode electrode while charging the redox-active anode electrode or an active material, whereas oxygen gas is generated during regeneration of the anode or the active material in a separate vessel or container or device, namely the regeneration device. The regeneration device being described herein is configured to hold a volume of an electrolyte solution at a temperature permitting regeneration of the redox active material. Gas generated during regeneration may be collected and stored. Thus, the regeneration device may be equipped with a gas outlet for collecting the formed gas.

The invention further provides a system for continuous generation of gases, the system comprising an electrochemical device comprising one or more electrodes; and a redox-active material regeneration device comprising a redox-active material, that is provided for charge regeneration or which has undergone regeneration, wherein the redox-active material is provided as an electrode material or as a dispersion thereof.

In some embodiments, the system for generation of gases comprises an electrochemical device comprising one or more electrode assemblies comprising an electrode of a redox-active material; and a redox-active material regeneration device.

In other embodiment, the system for generation of gases comprises an electrochemical device comprising a dispersion of a redox-active material and at least one electrode assembly; and a redox-active material regeneration device.

The invention further provides an electrochemical device for generation of a gas by utilizing at least one redox-active material having an oxidized form and a reduced form, the device is adapted and operable to output, while the device is in operation, the at least one redox-active material or a medium comprising same in an oxidized form from the electrochemical device to a region outside of the device and is adapted and operable to input, while the device is in operation, the at least one redox-active material or a medium comprising same in a reduced form from a region outside the electrochemical device back into the electrochemical device; such that the amount of the at least one redox-active material in a reduced form in the electrochemical device remains substantially constant during device operation, or such that the amount of the at least one redox-active material in a reduced form in the electrochemical device is effective to permit continuous and proper operation.

As used herein, the system and process of the invention permit a "continuous generation of gases". This means that both hydrogen and oxygen gases may be generated without stopping the operation of the system. While hydrogen gas may be generated in the electrochemical device on the cathode, while the anode is charged, generation of the anode results in oxygen gas generation in the regeneration device, as further disclosed herein. The risk of generating both gases within a single cell is removed and thus concomitant generation of gases is possible. Despite the fact that two devices are utilized to separate between the production of hydrogen gas and oxygen gas, the electrochemical device comprises at all times an amount of the reduced form of the redox-active material that is sufficient to allow for an effective, continuous proper generation of hydrogen gas. In a similar fashion, the regeneration device comprises at all times an amount of the oxidized redox-active material that has a sufficiently large residence time to allow for an effective, continuous and proper generation of oxygen. This amount of the redox-active material in each of the devices is governed by the type of electrode material, composition of the active material, volume of the reactor, volume of solvent within the, desired rate of gas generation and residence time in the respective vessel. The gas generating system is operated at steady state, where the flowrate of the active material throughout the system is constant. In other words, the active material or capsules containing same do not accumulate in any section. Thus, this amount is "sufficient to allow for an effective, continuous and proper operation of a device" or "sufficient to allow for an effective, continuous and proper generation of a gas".

The term "substantially constant" when in reference to the amount of the redox-active material means that at any time point the amount of the material in one or both devices, when in operation, remains the same or within ±10 wt %. In other words, the active material does not accumulate in one vessel and thus becomes depleted in the other.

In some embodiments, the electrochemical device is provided with an external closed loop system having at least one inlet permitting flow of material from the electrochemical device to a region outside of the device, at least one outlet permitting flow of material from the closed loop back into the device, and at least one regeneration device positioned between said inlet and outlet.

In some embodiments, the electrochemical device is provided with an external closed loop system having at least one inlet and at least one outlet, the external closed loop system defining a path of a moving electrode having a segment thereof in the electrochemical device and another segment thereof extending the length of the external closed loop, the external closed loop system being provided with at least one regeneration device positioned between said inlet and outlet.

In some embodiments, the electrochemical device is provided with means or a tool for removing an electrode from the device, while in operation, to an outside region of the device for regeneration. In such embodiments, the outside region may be at any distance from the electrochemical device and need not be in any association therewith.

In some embodiments, the active material is in the form of a material film on a surface region of an electrode or may be the electrode material itself. In such a configuration, the device comprises an electrode assembly comprising (i) at least two electrodes of the active material, or (ii) a movable electrode of the active material. Where the device comprises (i) two or more electrodes of the active material, at any time point one of the electrodes is operable in the process, while another electrode of the active material, e.g., being in an oxidized form in case the electrode is an anode or a reduced from in case the electrode is a cathode, may be disconnected and removed from the electrochemical device and regenerated. The regenerated electrode may thereafter be returned to the device and another electrode taken out from the electrochemical device to be regenerated.

To permit such removal and reintroduction of the electrode from and back into the device, the electrochemical device may be provided with a means or a tool for removing an electrode from the device, as mentioned above. The means or tool is provided in a form of a mechanical system that is configured and operable to attach to and move the electrode from the electrochemical device to the regeneration device and back into the electrochemical device. The mechanical system may be in the form of (or may comprise) a moving belt, a robotic arm, a mechanical lift, a rotary screw conveyor or any such displacing mechanism known in the art.

In some embodiments, the system of the invention is provided with a robotic arm that is configured to move the electrode, i.e., anode from and back into the electrochemical device or cell.

Where the system comprises a movable electrode of the active material, the device is provided with an external closed loop system and the electrode is structured as a continuous belt extending both the electrochemical device and regeneration device. At any time point during operation of the device, part of the electrode active material is in an oxidized form and the in other is in a reduced from, wherein the part of the device moving through the electrochemical device undergoes oxidation (and thus requires regeneration), and the other part moving through the regeneration device undergoes reduction and may be introduced back into the electrochemical device.

In the alternative, the active material is provided as active particles dispersed or immersed in the liquid medium of the electrochemical device, or as capsules or metallic carriers containing the active material. In such cases, the device is provided with an external closed loop system, through which the active material transfers or flows with or without the liquid medium. The amount of the active material in the electrochemical device remains effective and substantially constant throughout the continuous and uninterrupted operation of the electrochemical device. Active material that has undergone oxidation flows out of the cell and through the regeneration device, where it undergoes regeneration and then flows back into the electrochemical device, at a flow rate or a concentration that maintains the amount or concentration of the active material in the electrochemical device substantially constant.

In some embodiments, where the active material is provided in capsules, the flow rate is determined by the rotation rate of rotary valves through which the capsules are forced to flow into and out of the hydrogen generation section. The rotary valves also serve to isolate the capsules in the electrochemical section electrically from the capsules outside, confining the capsules charging to the electrochemical section, as further detailed herein.

The charged material that is transferred between the cells, as further explained below, must be electrically isolated to prevent further charging outside the electrochemical cell boundaries. To ensure such charge isolation, the capsulated electrodes may be configured to pass through a special set of valves, e.g., rotary valves, which electrically isolate the capsules material. An exemplary embodiment is shown in FIG. 6F, whereby one rotary valve is positioned at the inlet and a second at the electrode outlet. Each electrochemical cell is optionally provided with a pair of valves, each configured to isolate the active material, as disclosed herein, wherein a first of the of valves is positioned at an entry point to the electrochemical cell and a second of the valves is provided at an exist point from said cell, e.g., before entering the closed loop system.

In some embodiments, the valves are each a rotary valve. The valves in each cell are positioned in series, e.g., one after the other.

Alternatively, isolation gate valves, or tilting levers that allow passage of only a certain amount of capsules may be utilized.

Thus, the invention further provides an electrochemical device (or a system comprising thereof) for generation of a gas utilizing at least one redox-active material having an oxidized form and a reduced form, the device comprising an external closed loop configured and operable to output, while the device is in operation, the at least one redox-active material from the electrochemical device to a regeneration device positioned or associated with the external closed loop, and further configured and operable to input, while the device is in operation, the at least one redox-active material back into the device; such that the amount of the at least one redox-active material in the reduced form in the device remains substantially constant during device operation, or the amount remains substantially effective to allow a continuous device operation.

In some embodiments, the external closed loop system is provided with least one inlet permitting flow of the material from the electrochemical device to the regeneration device and at least one outlet permitting flow of material from the closed loop back into the device.

Also provided is an electrochemical device (or a system comprising thereof) for generation of a gas utilizing at least one redox-active material having an oxidized form (or a form capable of attracting a charge) and a reduced form (or a form not capable of attracting a charge), the device comprising a movable belt-shape electrode and an external closed loop system defining a path of the movable electrode, and a regeneration device integrally positioned or associated with the external closed loop system.

In some embodiments, the external closed loop system is provided with at least one inlet and at least one outlet, the external closed loop system defining the path of the moving electrode having a segment thereof in the electrochemical device and another segment thereof extending the length of the external closed loop, the external closed loop system being provided with at least one regeneration device positioned between said inlet and outlet.

The external closed loop system is associated to the electrochemical device through at least one pair of valves (an inlet valve and an outlet valve) that are operable to permit flow of the active material or movement of the belt electrode out and back into the electrochemical device. The inlet valve and the outlet valves defining an inlet and outlet of the external closed loop may be positioned at any two points on the electrochemical device. The size and shape of the external loop depends, inter alia, on the form of the active material, e.g., whether provided on a movable electrode or as a dispersion or contained or encapsulated in capsules or metallic carriers, the volume of the electrochemical device (reactor), the rate of oxidation of the active material, and other variables.

The external closed loop system is provided in the form of a continuous tubing or pipe or channel that is configured to comprise or hold an electrolyte solution that is maintained under conditions (e.g., temperature, pressure and composition) that are substantially identical to those defining the electrolyte medium in the reactor. The closed loop system is further configured to be associated with or is provided with one or more regeneration devices that may be an integral part of the closed loop channel or may be associated therewith. Irrespective of the position, size and the way the regeneration device is associated with the external closed loop channel, the regeneration device is positioned such that active material (in the form of dispersed matter or in the form of a belt electrode) flows or moves therethrough and undergoes regeneration in the process. The conditions employed in the regeneration device, including temperature, pressure and electrolytes may differ from those employed in the closed loop channel.

The external closed loop may be equipped with a selective filtering unit selected to allow directional movement of outflow from the electrochemical device and inflow from the closed loop system and the regeneration device back into the device. Thus, the external closed loop may be equipped with one or two such selective units; one positioned and operable to permit directional flow of oxidized active material from the device into the external closed loop and the regeneration device and a second positioned and operable to permit directional flow of regenerated active material from the regeneration device into the electrochemical device.

The external closed loop system may be alternatively configured to house in addition to the movable belt at least one electrolyte bath which purpose is, among others, to increase or decrease the temperature of the redox-active material. In an exemplary configuration, a system may comprise an electrochemical device and a regeneration device, the two being connected via two external closed loop systems; one extending an outlet of the electrochemical device and an inlet of the regeneration device and the other extending an outlet of the regeneration device and an inlet of the electrochemical device. Each of the two external closed loop systems may thus comprise the means for moving the redox-active material (e.g., a belt or rotary screw conveyors as disclosed herein) from one device to the other and optionally an electrolyte bath. Each of the electrolyte baths may further comprise means for moving the redox-active material therefrom to either the regeneration device or the electrochemical device. Thus, a system of the invention, as detailed herein, may comprise an electrochemical device, a regeneration device, one or two electrolyte baths and a number of mechanical elements, e.g., belts, or rotary screw conveyors, for moving the redox-active material from one device or bath to the other.

In some embodiments, the mechanical elements for carrying or moving or transporting the redox-active material from one device to the other via the external closed loop may be in the form of a belt or a rotary screw conveyor, as further disclosed herein.

In some embodiments, the mechanical elements for carrying or moving or transporting the redox-active material from one device to the other via the external closed loop may include a water seal that prevents the generated gases to mix.

Further provided is an electrochemical device (or a system comprising thereof) for generation of a gas utilizing at least one redox-active material having an oxidized form (or a form capable of attracting a charge) and a reduced form (or a form not capable of attracting a charge), the device comprising a rotary screw conveyor and an external closed loop system defining a path of the rotary screw conveyor, the conveyor being adapted for transporting the at least one redox-active material from said device to a device positioned or associated with the external closed loop system.

Also provided is an electrochemical device for generation of a gas utilizing at least one redox-active material having an oxidized form and a reduced form, the device comprising a rotary screw conveyor configured and operable to lift the active material and transport it from the electrochemical device and into a generation device, wherein the electrochemical device and regeneration device are associated through an external closed loop system defining a path of the active material, and wherein the regeneration device is integrally positioned or associated with the external closed loop system The rotary screw conveyor may be positioned vertically or at an angle to the surface of the electrochemical device.

In some embodiments, the device positioned or associated with the external closed loop device is a regeneration device.

In some embodiments, the external closed loop housing the rotary screw conveyor may further contain an electrolyte bath positioned between an external end of the rotary screw conveyor (namely at the end of the conveyor of the electrochemical device) and an inlet of the regeneration device. The electrolyte bath is typically maintained at a temperature that is higher than the temperature of the medium in the electrochemical device yet lower than the temperature of the medium in the regeneration device (namely having an intermediate temperature).

Thus, in some embodiments, the external closed loop system comprises a rotary screw conveyor that is configured to transport the redox-active material out from the electrochemical device, and at least one electrolyte bath. To allow transport of the at least one redox-active material from the electrolyte bath to the regeneration device, the electrolyte bath may be provided with a further rotary screw conveyor, having its proximal end associated to the electrolyte bath and its top outlet above the electrolyte level, associated to the regeneration device. In a similar fashion, the regeneration device may also comprise a rotary screw conveyor that is associated, at its bottom end, to the regeneration device, and at its top end to a further electrolyte bath, now maintaining a temperature that is lower than that in the regeneration device, but higher than in the electrochemical device. The further electrolyte bath may be associated to the electrochemical device through an external closed loop system that houses a yet additional rotary screw conveyor for transporting the at least one redox-active material back into the electrochemical device.

Either of the electrodes of an electrode assembly may undergo regeneration in accordance with systems and methods of the invention.

In an exemplary electrochemical device according to the invention, the device comprises at least one electrochemical cell in a form of a compartment/container that comprises at least one electrode assembly (each electrode assembly comprising a cathode electrode and an anode electrode) and configured for holding an aqueous (electrolyte) solution. During operation of the device (i.e., application of an electrical bias), a gas, such as hydrogen, is generated on the cathode electrode whereas oxidation of the redox-active material takes place on the anode electrode. Accordingly, in some implementations, the cathode is or comprises a hydrogen evolution catalyst. The cathode may be of a material selected from a metal and an electrode material used in the field. In some embodiments, the cathode is or comprises a metal or a metal alloy. In other embodiments, the cathode is or comprises platinum, palladium, iridium, rhodium, nickel, zinc, aluminum, Raney nickel and combination thereof. Where the electrode is or comprises a metal alloy, the material may be selected from nickel-cobalt, nickel-molybdenum, nickel-manganese and others. Alternatively, the electrode may consist of a conducting carbon or a metal composite material.

The anode, on the other hand, is configured to allow oxidation of the redox-active material, namely to allow generation of an oxidized material. In accordance with some embodiments, the anode is or comprises a metal and/or a metal oxide and/or a metal hydroxide and/or a conducting carbon or polymer coated with an active material. In some embodiments, the anode is or comprises nickel, cobalt, manganese or iron. In some embodiments, the anode is or comprises nickel hydroxide with or without additives at various contents.

The oxidized material may be transported from the electrochemical device to the regeneration device, as detailed herein, where it may undergo a spontaneous reduction (in the absence of an applied bias) resulting also in generation of oxygen gas. In such cases, therefore, the regeneration device may act as an oxygen generating device and be provided under gas generating conditions. In some embodiments, the regeneration device is thus associated with a gas collecting device.

A regeneration device operating as an oxygen generating device may be operated in the absence of electrical bias, e.g., with no voltage or with a voltage or a direct current that is lower than the detection limit of a voltage or current detection device. In some embodiments, absence of electrical bias is any bias below 1.23V, or any value up to 1.23V (as noted with reference to a monopolar arrangement and correspondingly as defined above for bipolar arrangements) or any value that is substantially similar or functionally equivalent.

As detailed herein, reduction of the oxidized material and the concomitant generation of oxygen gas occurs at elevated temperatures. Hence, in accordance with some embodiments, the regeneration device or the oxygen generating device may comprise a heat source or a heat exchanger. The heat source and/or the heat exchanger may be used to set the temperature in the regeneration device. In accordance with some embodiments, the temperature used is at least 50° C., at times at least 60° C., at times at least 70° C., at times at least 80° C., at times at least 95° C., at times at least 115° C., at times at least 135° C., at times between 50° C. to 135° C., at times between 60° C. and 135° C., or at times between 70° C. and 135° C.

As stated herein, the redox-active material may be provided in the form of dispersion. This dispersion is typically water dispersion or an aqueous dispersion comprising water, as a medium and different analytes. The aqueous medium, being an electrolyte solution, comprises a metal electrolyte that is optionally selected from Li, Na, K. Rb, Cs, Ca, Sr and Ba cations, of various anions or hydroxides. In some embodiments, the metal is an alkali metal. In some embodiments, the electrolyte comprises a metal hydroxide. In some embodiments, the metal hydroxide is NaOH or KOH. In some embodiments, the aqueous solution is carbonate-bicarbonate buffer electrolyte.

The aqueous solution may be characterized by a pH above 7, optionally at least 8, optionally at least 9, optionally at least 10, optionally at least 11, optionally at least 12, optionally at least 13, or optionally 14. In some embodiments, the aqueous solution is an acidic solution (having a pH below 7 or between 1 and 7).

Systems of the invention may comprise one or more electrochemical devices and one or more regeneration devices. In some implementation, a plurality of electrochemical devices may be associated with a single external closed loop, equipped with one or more regeneration devices. In such a case, the external closed loop system may be provided with a plurality of inlet valves.

Systems of the invention may further comprise a control unit which may be physically or remotely (e.g. wirelessly) connected to each of the electrochemical devices and/or regeneration devices or to the system as a whole. Such a control system is configured for setting the charging current and active material transfer rates according to the available power input or required hydrogen and oxygen production rates.

Systems of the invention that comprise two or more or a plurality of devices, as defined herein, may be provided in a bipolar form or in a monopolar form.

The present invention further comprises a continuous process for producing hydrogen gas and optionally oxygen gas in an electrochemical device, the process comprising:

a—continuously generating hydrogen gas and an oxidized active material in the electrochemical cell;

b—while generation of hydrogen gas continuous, flowing or transporting the oxidized active material to a region outside the electrochemical cell, said region is suited for regenerating the (reduced) active material;

c—regenerating the active material and producing oxygen gas;

d—flowing the active material back into the electrochemical cell; and e—repeating steps a-d one or more times to simultaneously produce hydrogen gas while regenerating the active material thereby producing oxygen gas. The repeating step defines continuous production of both gases.

In some embodiments, hydrogen gas is generated in an electrochemical step on a cathode electrode, in the presence of an applied bias resulting in generation of hydroxide ions.

In some embodiments, the oxidized material is generated by oxidation of the reduced material in the presence of hydroxide ions.

In some embodiments, oxygen gas is generated in a spontaneous chemical step, in the absence of bias, in the regeneration device, optionally by increasing the temperature concomitantly with reduction of the oxidized material to generate the reduced material.

BRIEF DESCRIPTION OF THE DRAWINGS

In order to better understand the subject matter that is disclosed herein and to exemplify how it may be carried out in practice, embodiments will now be described, by way of non-limiting example only, with reference to the accompanying drawings, in which:

FIGS. 6A-F depict a system design for continuous decoupled E-TAC water splitting system. Schematic illustrations of (FIG. 6A) the basic cell design, showing one cell out of the four cells composing the system; (FIG. 6B) a screw conveyor, which is used to move pelletized electrodes (also shown in Compartment B in FIG. 6A); (FIG. 6C) the pelletized electrodes forming a packed moving bed; (FIG. 6D) a complete four-cell system, without details of inner cell design, illustrating movement of a single pellet; (FIG. 6E) zoom in on the electrochemical cell (Cell 1 from FIG. 6D) showing the internal cell design and components; and (FIG. 6F) zoom-in on the inlet/outlet of the electrochemical cell from E, showing the electrical isolation mechanism of the pellets.

DETAILED DESCRIPTION OF EMBODIMENTS

Figure 1:
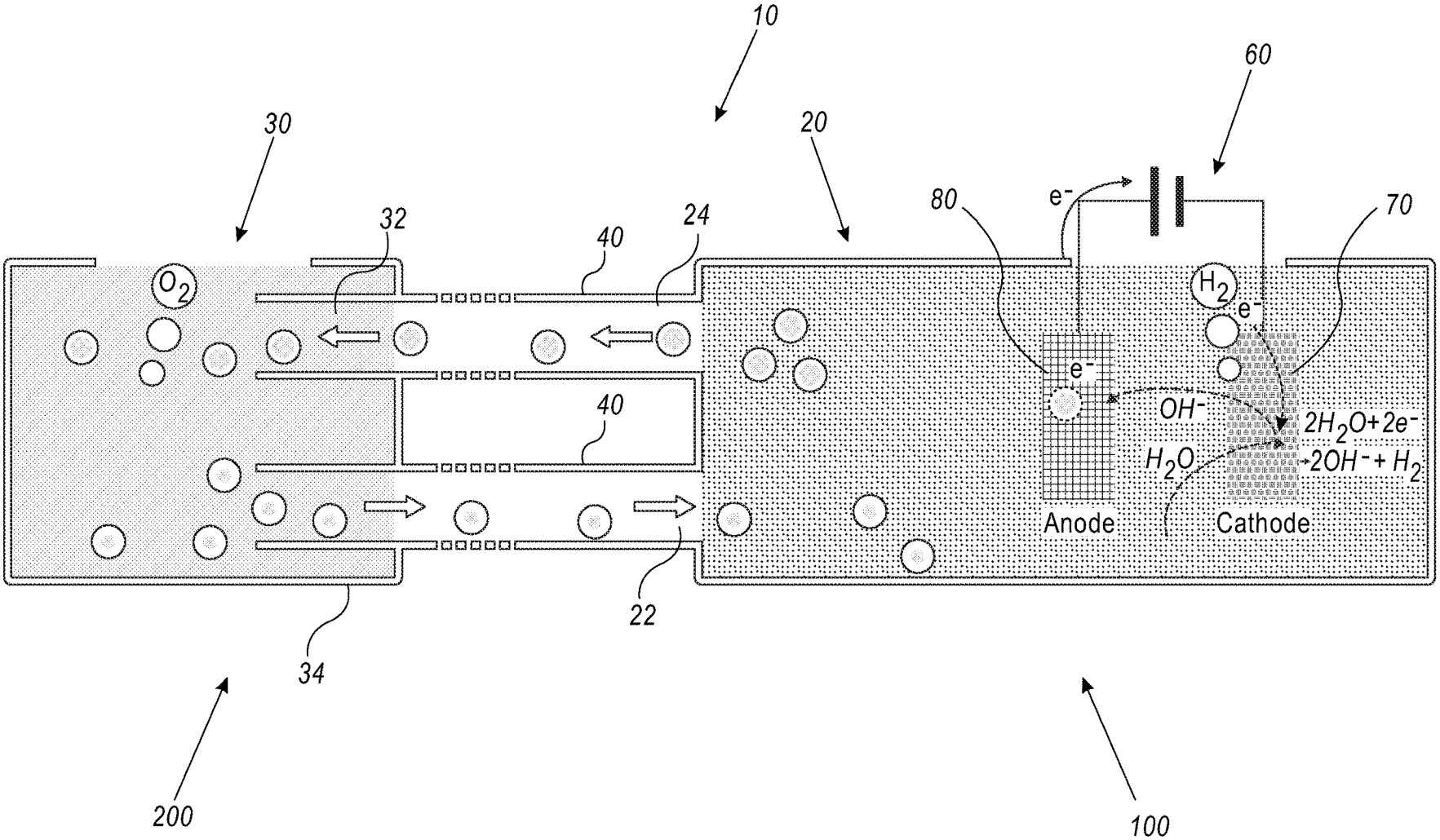
FIG. 1 is a schematic representation of a system comprising an electrochemical thermally activated chemical cell and a regeneration device in accordance with some embodiments.

FIG. 1 is an exemplary schematic representation of a system 10 of the invention comprising an electrochemical thermally activated chemical cell 20 according to some embodiments of the invention and a regeneration device 30. The system 10 is generally constructed of an electrochemical device 100 and external closed loop system 200 that is provided with a regeneration device 30. The electrochemical device 100 comprises, in the particular embodiments, an electrochemical cell (or reactor) 20, an electrode assembly 60 comprising a cathode electrode 70 and an anode electrode 80. The electrochemical device is provided with an outlet 24 to the external closed loop channel (40) and an inlet 22. The external loop channel (40) is connected to the regeneration device via inlet 32 and outlet 34.

Figure 2A:
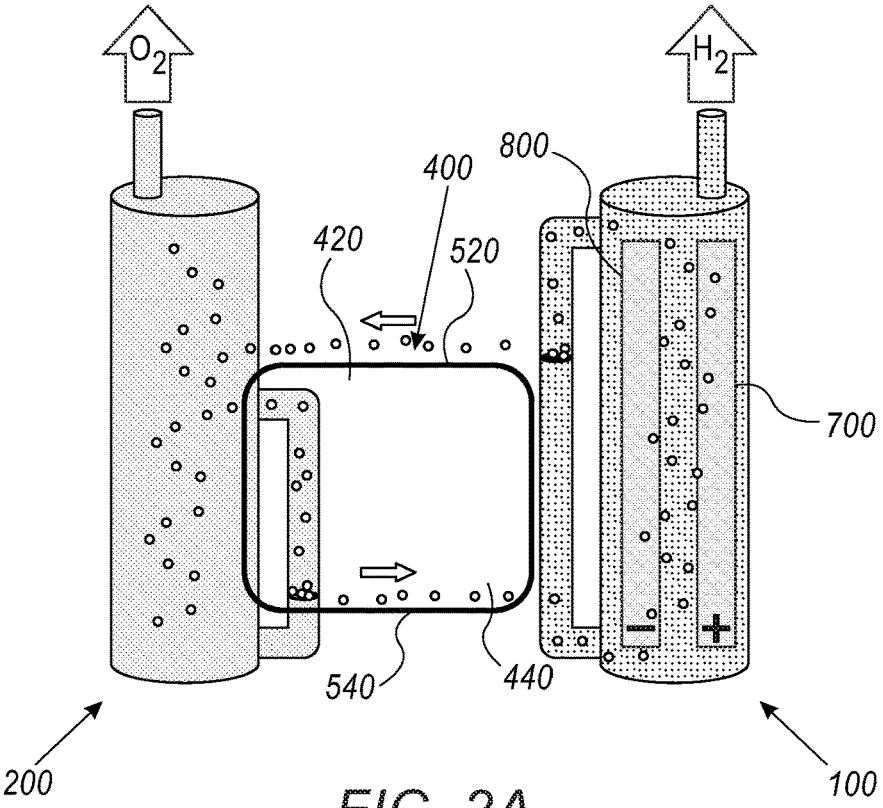
FIGS. 2A and 2B are schematic representations of a system comprising an electrochemical thermally activated chemical cell and a regeneration device in accordance with some embodiments of the dispersed redox-active material particles aspect.
Figure 2B:
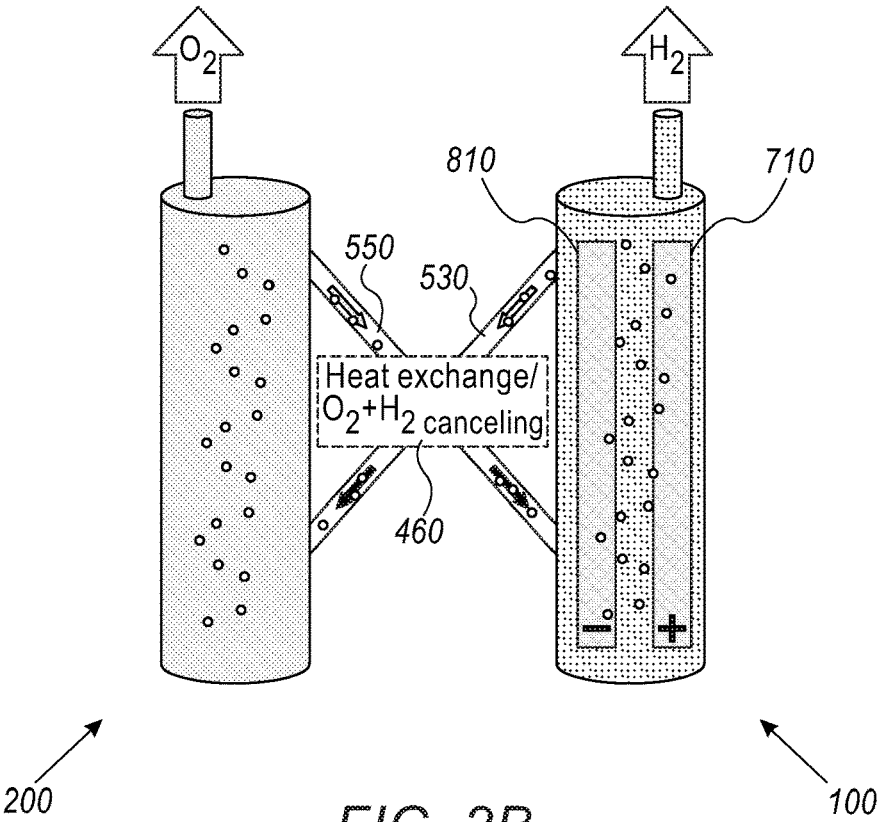

FIGS. 2A and 2B show further examples of systems of the invention. In FIG. 2A, the electrochemical device 100 is associated to the regeneration device 200 as shown. The electrochemical device comprises a cathode electrode 700 and an anode electrode 800. The electrochemical device is provided with an external closed loop system 400, comprising channels 420 and 440 collectively forming a pipe system having a belt like shape. The pipe assembly allows movement of the aqueous solution comprising the oxidized material in the form of particles 520 via the channel 420 from the electrochemical device to the regeneration device (i.e., the oxygen generating device) and movement of the aqueous solution comprising the reduced material 540 back to the electrochemical device.

In FIG. 2B, the electrochemical device 100 and the regeneration device 200 are provided with an external closed loop system that is equipped with a heat exchange unit 460. Oxidized material in the form of particles 530 is flown from the electrochemical device to the regeneration device (i.e., the oxygen generating device) via the heat exchange unit. The reduced material (regenerated active material) 550 from the regeneration device is flown back into the electrochemical device.

Figure 3:
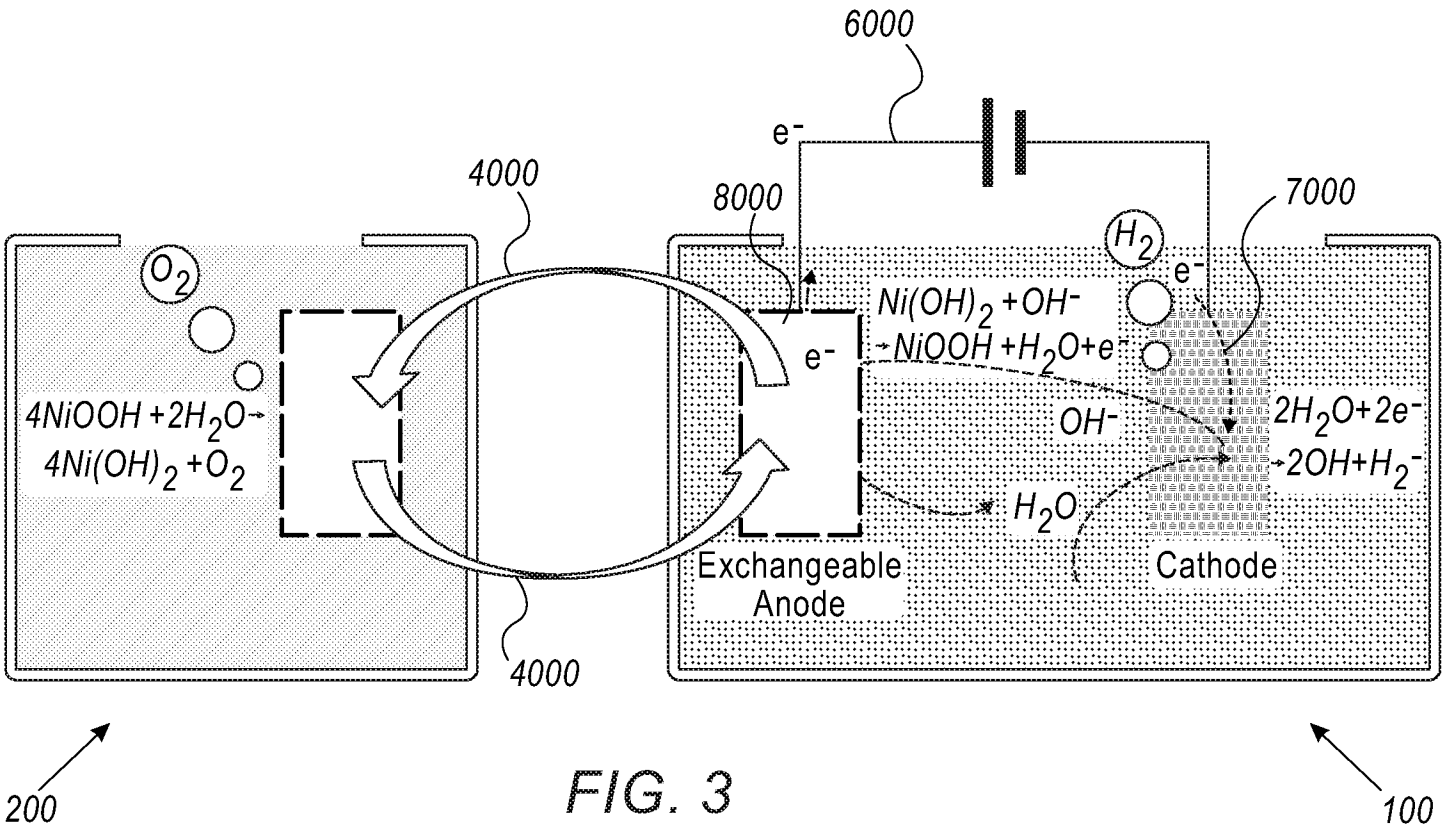
FIG. 3 is a schematic representation of a system of the invention in accordance with some embodiments of the redox-active material anode aspect.
Figure 4:
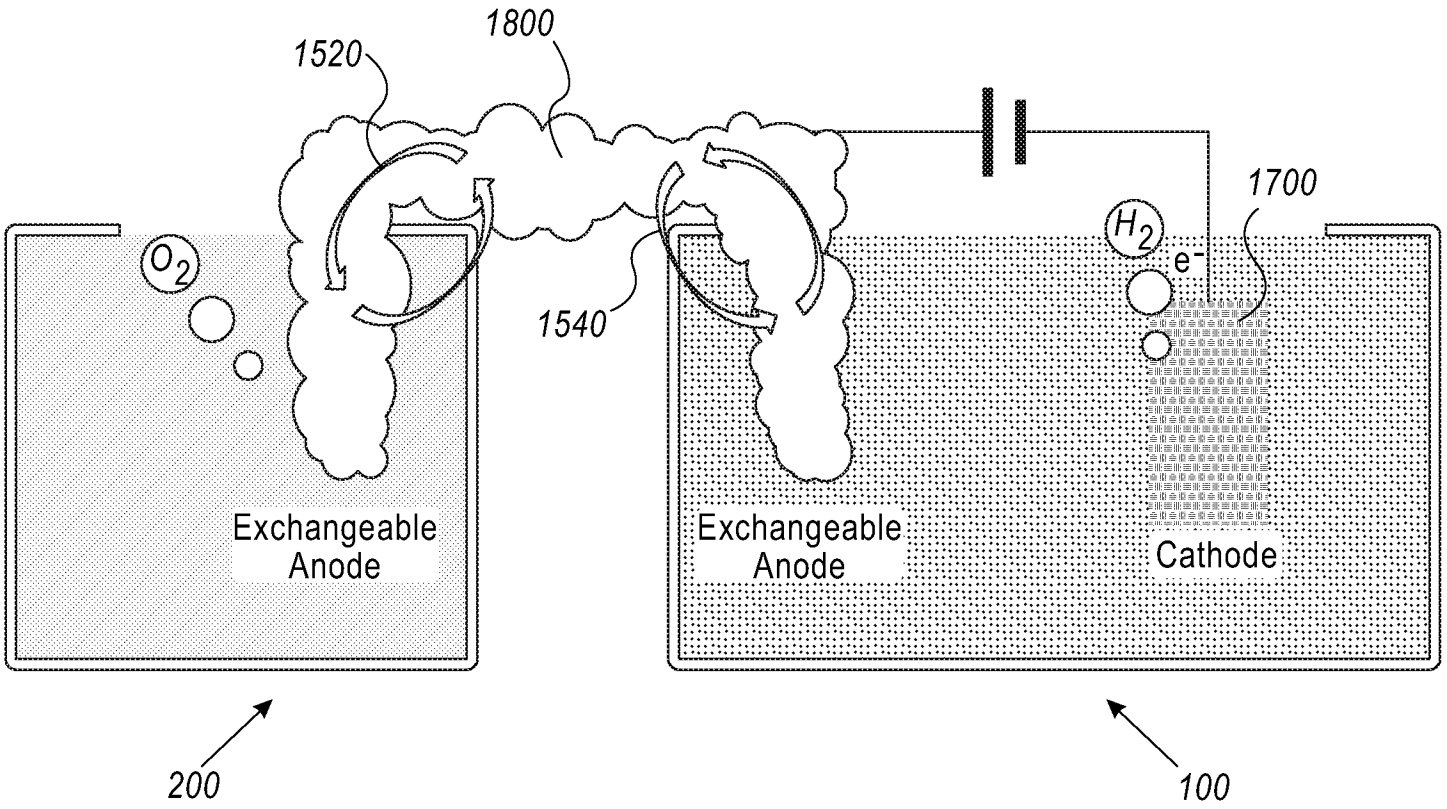
FIG. 4 is a schematic representation of a system of the invention, showing the electrochemical thermally activated chemical cell and the regeneration device in accordance with some embodiments of the redox-active material anode aspect. The design includes an exchangeable anode electrode which extends into the regeneration device.

Turning to FIG. 3, another embodiment of a system of the invention is depicted. In this example, an electrochemical device 100 comprises an electrode assembly 6000 that comprises a cathode electrode 7000 and an anode electrode 8000. The system comprises transport assembly 4000 allowing movement of the anode 8000 from the electrochemical device to a regeneration device 200 and back to the electrochemical device after regeneration. As noted herein, the transport assembly may be any mechanical means capable of attaching to and moving or carrying the anode from one vessel to the other. An alternative is shown in FIG. 4. The electrochemical device 100 comprises a cathode electrode 1700 and an exchangeable anode electrode 1800 that extends into the regeneration device 200. The exchangeable anode may be moved from vessels 100 to 200 and back by suitable mechanism (1520 and 1540), e.g., a moving belt, wire, mechanic arm, conveyor belt, a rotating screw and others, as disclosed herein.

Figure 5:
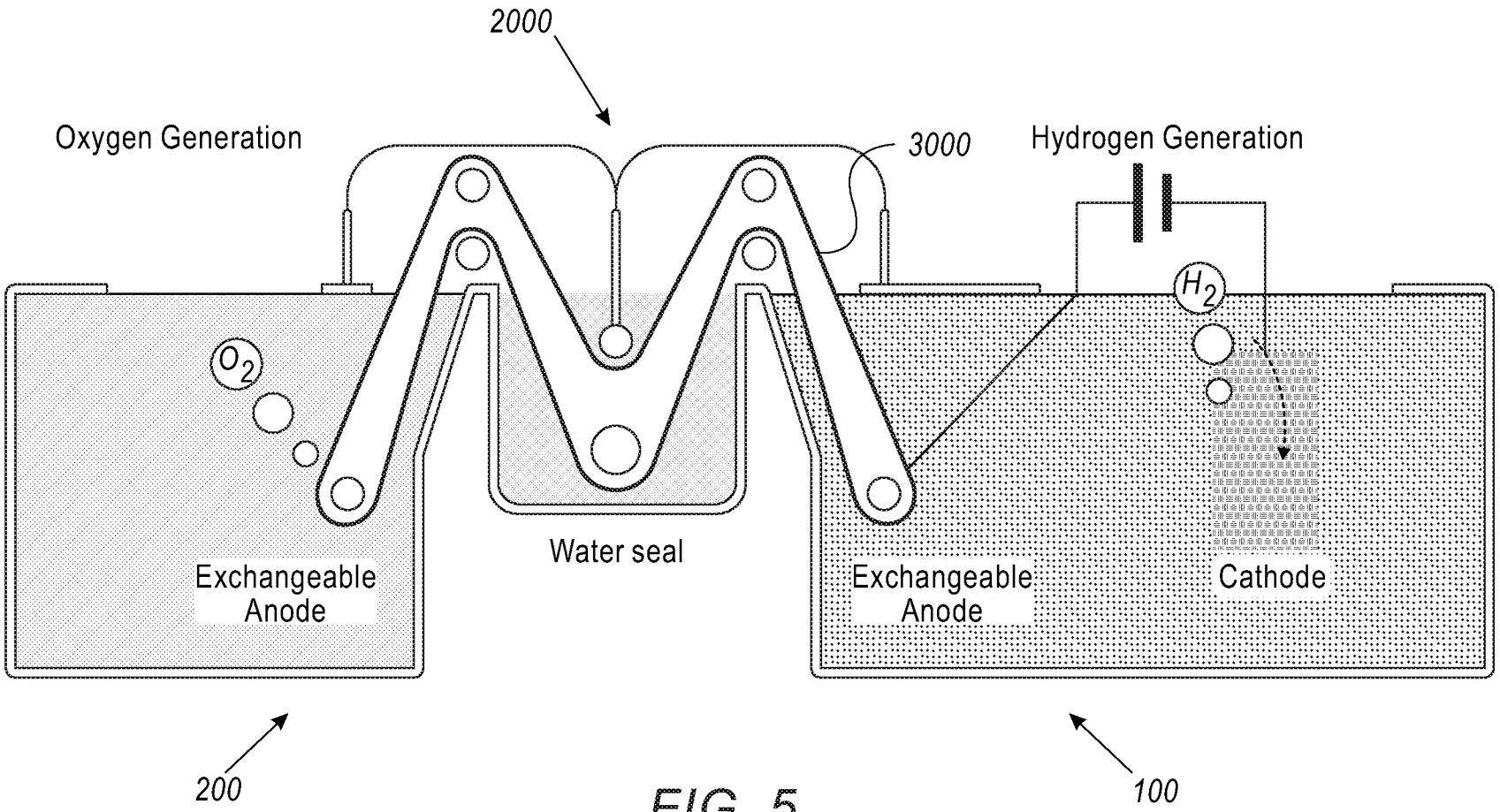
FIG. 5 is a schematic representation of a system of the invention in accordance with some embodiments of the moving belt aspect.

FIG. 5 shows yet another configuration of a system of the invention. In this configuration, the external closed loop system 2000 extending between the electrochemical device 100 and the regeneration device 200 is shaped to contain a movable electrode 3000 extending the length of the closed loop system. The system may also comprise a water seal in the form of a container, receptable, or any other article acting as a separate zone through which the movable electrode moves (as shown). The water seal comprises water hence permitting transfer of active particles but preventing passage of gases from one end of the seal to the other. The water seal may be maintained at a temperature that is midpoint to the temperatures in each of the vessels, as described herein.

Another mechanically circulated system is proposed herein. In this system, the electrode active material is moved while maintaining full separation of the solutions (the solution of the electrochemical device and the solution in the regeneration device). This mechanical system is illustrated in FIG. 6. In some embodiments of the system, it comprises four cells, wherein each cell is divided into two compartments, as shown in FIG. 6D. A single cell is depicted in FIG. 6A. To facilitate movement of the electrode active material without moving the electrolyte, a vertical screw conveyor is used for lifting the active material above the electrolyte liquid level, transporting the material from one cell to another. In each cell the active material is inserted into compartment A (FIG. 6A), and compartment B contains the screw conveyor that lifts the active material up and out of the cell. A typical screw conveyor is illustrated in FIG. 6B. The active material forms a "particle-bed" that is continuously circulated throughout the system, as shown in FIG. 6C, at a rate that is set by the screw conveyor rotating speed, the pitch and diameter of the screw.

Figure 7A:
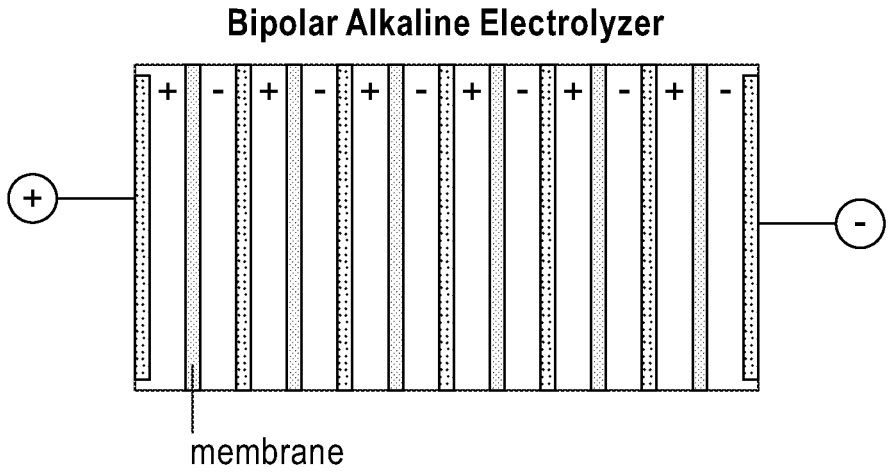
FIGS. 7A-B provide (FIG. 7A) conventional bipolar design in alkaline electrolysis, and (FIG. 7B) bipolar design in a proposed four-cell system according to the invention.
Figure 7B:
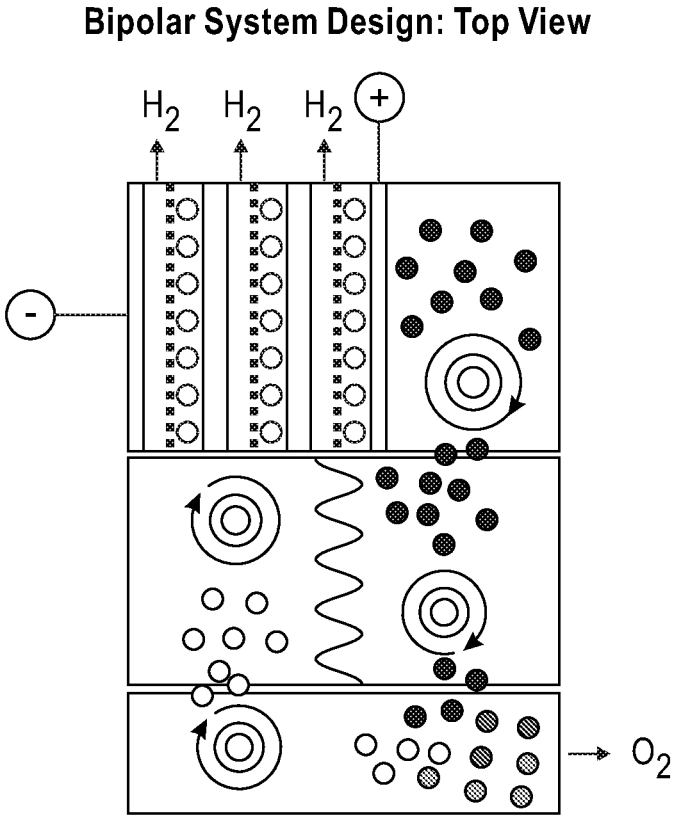

In the particular embodiment, a four system cells configuration is shown in FIG. 6D: an electrochemical cell at ambient temperature, two intermediate temperature cells at 60-65° C. and a chemical reaction cell at 95° C. FIG. 6D illustrates the movement of the active material within the system; the electrochemical cell (Cell 1 in FIG. 6D) design is different from the other cells, as it must contain electrical components. A detailed sketch of Cell 1 is shown in FIG. 6E, containing a cathode and a current collector (e.g., nickel) for the active material, which together with the material, forms the anode. The cathode and anode are connected to the power source, and a mesh screen made of a conducting material is placed between the cathode and anode to prevent the active material from contacting the cathode and short-circuiting the cell. Cell 1 is kept at ambient temperature (25° C. or so) and fresh active material is inserted into compartment A of Cell 1. The material moves along a current collector. As the material flows through Compartment A of Cell 1, it is gradually charged while hydrogen is produced at the cathode. The charged material that is transferred to Compartment B of Cell 1 must be electrically isolated from the material in Compartment A, to prevent further charging beyond the electrochemical cell boundaries. To ensure this, the electrodes may be configured to pass through special rotary valves that electrically isolate the material in Compartment A. As shown in FIG. 6F, one rotary valve is positioned at the inlet and a second at the electrode section outlet. The set of rotary valves define independent pathway of anode pellets with active material. Each pathway can have a cathode, a current collector and isolated pellets with active material moving through the pathway. The electrodes can be connected in series (anode to adjacent cathode) to allow bipolar operation as shown in FIGS. 7A-B.

Back to FIG. 6D, the charged active material is then lifted by the conveyor in Compartment B and transferred to Cell 2, and optionally kept at approximately 60° C. This cell (as well as Cell 4) serves as temperature buffers, lowering the direct heat transfer between the cold and hot cells. These cells also form hydraulic locks, preventing hydrogen produced in Cell 1 from entering the oxygen generation cell (Cell 3) and vice versa. In Cell 2, the temperature of the material increases to the cell temperature, and then transferred to Cell 3, which is the hot chemical reactor kept at ~95° C. In contrast to Cell 1, wherein the charging reaction can only occur while the active material is in contact with the current collector, the discharging reaction in Cell 3 is chemical, induced by the hot temperature in the cell. Therefore, it can occur in both compartments of Cell 3 and may spill over into Cell 4. However, the chemical reaction rate decreases with time and temperature. This behavior could be used to prevent $O_2$ production in Cell 4, by controlling the residence time of the material in Cell 3 so that $O_2$ release is nearly complete by the time the pellets enter Cell 4, and by further quenching the reaction completely by the lower temperature in Cell 4. Heat is exchanged between Cells 2 and 4 to maintain both cells at 60-65° C. Finally, the active material is transferred from Cell 4 back to Cell 1 through the upper isolation rotary valve. To ensure equal pressure above the electrolytes in the $H_2$ and $O_2$ sections, the headspaces of compartments A and B of Cell 1 is shared and similarly in Cell 3. Additionally, the $H_2$ headspace in Cell 1 is connected to part A of Cell 2 and part B of Cell 4. Likewise, the $O_2$ headspace in Cell 3 is connected to part B of Cell 2 and part A of Cell 4. Back pressure regulators are placed at the $H_2$ and $O_2$ headspaces outlets to maintain an equal pressure in every compartment. In this way the liquid level in compartments A and B of Cells 2 and 4 remain balanced. This stresses the important role of Cells 2 and 4 as hydraulic locks for safe operation. However, since the headspace of compartments A and B of Cells 2 and 4 contain $H_2$ and $O_2$ respectively, some dissolution of these gases into the electrolyte can occur. To prevent dissolved $H_2$ and $O_2$ from accumulating in Cells 2 and 4, a catalyst may be added to both cells (e.g., Pd) to promote the reaction of dissolved $H_2$ and $O_2$ back to $H_2O$. This can lead to a minor loss of efficiency, but at the same time will increase safety of operation.

A Robot-Equipped System for Generation of Gases

A set-up system was constructed which comprises an electrochemical device, an electrolyte bath and a regeneration device. A robot arm was positioned to withdraw and electrode, i.e., the anode electrode, from the electrochemical cell, through the electrolyte bath and into the regeneration device. Gas evolution was observed.

The working electrode was the one moved between the devices. A counter and (optional) reference electrodes were stationary. The moving (working) electrode spent a predefined time in each device.

A pre-defined current was applied when the electrode was fully positioned in the electrochemical cell. Temperature was controlled as well. Temperatures, currents and voltages were monitored and logged.

The time period needed for moving the working electrodes between the devices was a few seconds.

A robotic arm was used to move the electrode in the system. Operation of the arm was managed through NI LabVIEW dedicated software.

The electrodes were tested at RT in a 3-electrode cell assembly (Hg/HgO Reference electrode, Ni Metal Counter electrode (5M KOH electrolyte) using "Ivium" potentiostat. The cycling test regime included the following steps:

Rest: OCV (Open Circuit Voltage) for 10 sec.

Electrochemical Charging (hydrogen production): Constant Current of 50 $mA/cm^2$ for 130 sec or cutoff voltage of 0.58V (vs. Hg/HgO).

Rest: OCV (Open Circuit Voltage) for 70 sec.

Thermal-Chemical Discharge (oxygen generation): Electrode was moved into the regeneration vessel containing a hot electrolyte (95-100° C.) for 130 sec.

Rest: OCV (Open Circuit Voltage) for 70 sec.

The electrode was tested for 300 ETAC cycles showing efficient and stable regeneration efficacy and behavior.

The invention claimed is:

1. A system for generation of gases, the system being arranged as a closed-loop system comprising an electrochemical device comprising one or more electrode assemblies comprising a movable electrode of a redox-active material, said movable electrode is configured for being movable between the electrochemical device and a regeneration device that is external to the electrochemical device, wherein the redox-active material is formed as a material film on a surface region of the movable electrode or wherein the movable electrode is formed of the redox-active material; and wherein the system is provided with a mechanical system configured and operable to attach and move the movable electrode from the electrochemical device to the regeneration device, wherein the mechanical system is optionally in a form or comprising a moving belt, a robotic arm, a mechanical lift or a displacing mechanism.

2. The system according to claim 1, wherein the electrochemical device is provided with an external closed loop system having at least one inlet and at least one outlet, the external closed loop system defining a path of a moving electrode having a segment thereof in the electrochemical device and another segment thereof extending the length of the external closed loop, wherein the at least one regeneration device is positioned between said inlet and outlet.

3. The system according to claim 1, wherein the movable electrode is structured as a continuous belt extending both the electrochemical device and regeneration device.

4. The system according to claim 3, wherein part of the electrode active material is in an oxidized form and another part of the electrode is in a reduced form, and wherein the part of the electrode moving through the electrochemical device undergoes oxidation and the part moving through the regeneration device undergoes reduction.

5. An electrochemical device for generation of a gas utilizing an electrode being formed of or having a surface of at least one redox-active material having an oxidized form and a reduced form, the device comprising an external closed loop configured and operable to output, while the device is in operation, the electrode formed of or having the surface of the at least one redox-active material from the device to a regeneration device positioned or associated with the external closed loop, and further configured and operable to input, while the device is in operation, the electrode formed of or having the surface of the at least one redox-active material back into the device; such that the amount of the at least redox-active material on the electrode in the reduced form in the device remains substantially constant during device operation, wherein the external closed loop further comprises an electrolyte bath positioned between an outlet of the electrochemical device and an inlet of the regeneration device, and wherein the electrolyte bath is maintained at a temperature higher than the temperature of the electrolyte medium in the electrochemical device and lower than the temperature of the electrolyte medium in the regeneration device.

6. The device according to claim 5, wherein the external closed loop system is provided in the form of a continuous tubing or pipe or channel that comprises an electrolyte solution that is maintained under conditions substantially identical to conditions defining the electrolyte medium in the electrochemical device.

7. A system comprising a device according to claim 5.

8. A continuous process for producing hydrogen gas and optionally oxygen gas in a closed-loop system comprising an electrochemical device, the electrochemical device comprising an electrode assembly and a movable electrode formed of or having a film of a redox-active material, the process comprising:

while continuously generating hydrogen gas, transporting the electrode formed of or having a film of the redox-active material in an oxidized form to a region outside the electrochemical cell, said region comprising a regeneration device;

generating the redox-active material and producing oxygen gas;

transporting the electrode formed of or having a film of the redox-active material in a reduced form back into the electrochemical cell; and repeating the process one or more times to simultaneously produce hydrogen gas while regenerating the electrode redox-active material.

* * * * *